US008983314B2

(12) United States Patent
Atarashi

(10) Patent No.: US 8,983,314 B2
(45) Date of Patent: Mar. 17, 2015

(54) IMAGE FORMING APPARATUS CAPABLE OF DETECTING CONTACT FUSION, AND RELAY CONTROL APPARATUS

(75) Inventor: Eijiro Atarashi, Toride (JP)

(73) Assignee: Canon Kabushiki Kaisha (JP)

( * ) Notice: Subject to any disclaimer, the term of this patent is extended or adjusted under 35 U.S.C. 154(b) by 304 days.

(21) Appl. No.: 13/098,730

(22) Filed: May 2, 2011

(65) Prior Publication Data

US 2011/0274450 A1 Nov. 10, 2011

(30) Foreign Application Priority Data

May 6, 2010 (JP) ..... 2010-106404

(51) Int. Cl.
*G03G 15/00* (2006.01)
*G03G 15/20* (2006.01)
*G03G 21/16* (2006.01)

(52) U.S. Cl.
CPC ..... *G03G 15/205* (2013.01); *G03G 15/2078* (2013.01); *G03G 15/55* (2013.01); *G03G 15/80* (2013.01); *G03G 21/1685* (2013.01); *G03G 2215/2032* (2013.01); *G03G 2221/1639* (2013.01)
USPC ..... 399/37

(58) Field of Classification Search
CPC ..... G03G 15/80; G03G 15/55
USPC ..... 399/33, 37, 88; 219/216
See application file for complete search history.

(56) References Cited

U.S. PATENT DOCUMENTS

| | | | | |
|---|---|---|---|---|
| 4,516,076 | A * | 5/1985 | Pillari et al. | 324/418 |
| 6,059,197 | A * | 5/2000 | Kurahashi et al. | 237/12.3 R |
| 6,989,978 | B2 * | 1/2006 | Hiraku et al. | 361/86 |
| 2006/0021098 | A1 * | 1/2006 | Tezuka | 903/922 |

FOREIGN PATENT DOCUMENTS

| | | | |
|---|---|---|---|
| JP | 2002-296955 | A | 10/2002 |
| JP | 2009168404 | A * | 7/2009 |

OTHER PUBLICATIONS

Machine translation of Azuma, JP 2002-296955.*
Machine translation of Yamagishi, JP 2009-168404.*
Abstract of Shin, JP 2011-237480.*

* cited by examiner

*Primary Examiner* — David Gray
*Assistant Examiner* — Sevan A Aydin
(74) *Attorney, Agent, or Firm* — Rossi, Kimms & McDowell LLP

(57) ABSTRACT

An image forming apparatus which can individually detect contact fusion of relays in a circuit configuration in which the relays are connected to respective both ends of a fixing heater. A first relay and a second relay are each connected between a power source and the fixing heater. The presence or absence of an input voltage to the fixing heater is detected on paths from the first relay to the fixing heater and from the second relay to the fixing heater. When the input voltage is detected in a state in which the first relay is on and the second relay is off, it is determined that the second relay has failed. When the input voltage is detected in a state in which the first relay is off and the second relay is on, it is determined that the first relay has failed.

5 Claims, 5 Drawing Sheets

IMAGE FORMING APPARATUS CAPABLE OF DETECTING CONTACT FUSION, AND RELAY CONTROL APPARATUS

BACKGROUND OF THE INVENTION

1. Field of the Invention

The present invention relates to an image forming apparatus such as a copier or a printer, which forms images on recording materials using an electrophotographic process, and a relay control apparatus, and in particular to a power-feed path of a fixing apparatus that thermally fixes unfixed toner formed and carried on recoding materials.

2. Description of the Related Art

Conventionally, for electrophotographic image forming apparatuses, methods that heat and fix a toner image formed on a recording sheet (heat fixing methods) have been commonly adopted, and in particular, a method that brings a toner image into direct contact with a rotary member having a heat source therein and fixes the toner image has been in widespread use. As the heat source, a halogen heater, a ceramic heater, an IH heating, and so on are known, but all of them require so large amount of power as hundreds of watts.

Moreover, with an increase in demand for power saving, reducing standby electricity of image forming apparatuses has become an important issue. Thus, there has been proposed an image forming apparatus that raises fixing temperature at high speed by an on-demand fixing technique using a ceramic heater, and thus hardly requires standby electricity.

On the other hand, in such a fixing apparatus that raises fixing temperature at high speed, the temperature of a fixing heater abruptly rises, and it is thus important to quickly interrupt electric current to the fixing heater when an abnormal condition occurs. Moreover, to reliably interrupt electric current to the fixing heater, it is necessary to stop supplying electrical power to both ends of the fixing heater.

To stop the supply of electrical power to the fixing heater, a mechanical relay is commonly used. The relay uses a contact, and hence if the relay is repeatedly turned on and off, the contact may be welded due to age deterioration. If the contact of the relay is welded, electric current is passed through the fixing heater even when the relay is turned off, and thus power feeding to the fixing hearer does not stop, which may result in abnormal heating. To cope with this, there has been proposed a method that a zero cross detection circuit for detecting the presence or absence of input voltage is provided in a stage subsequent to the relay, and when a zero cross signal is output despite the mechanical relay being instructed to turn off, it is determined that contact fusion of the relay occurs (for example, see Japanese Laid-Open Patent Publication (Kokai) No. 2002-296955).

The above described method makes it possible to detect contact fusion of the relay by disposing the zero cross circuit in the stage subsequent to the relay.

However, when relays are disposed at respective both ends of the fixing heater, the zero cross circuit can detect contact fusion only when contacts of both relays are welded, and the zero cross circuit cannot detect contact fusion occurring in either one of the relays. For this reason, the above described method is insufficient in terms of safety.

SUMMARY OF THE INVENTION

The present invention provides an image forming apparatus that is capable of, in a circuit configuration in which relays are connected to respective both ends of a fixing heater, individually detecting contact fusion occurring in the respective relays, and a relay control apparatus.

Accordingly, a first aspect of the present invention provides an image forming apparatus comprising a heater configured to be supplied with electrical power from a power source, a first relay and a second relay each configured to be connected between the power source and the heater, a voltage detection unit configured to detect presence or absence of an input voltage to the heater on paths from the first relay to the heater and from the second relay to the heater, and a relay control unit configured to output control signals for turning on and off respective ones of the first relay and the second relay, wherein the relay control unit determines that the second relay has failed when the input voltage is detected by the voltage detection unit in a state in which the first relay is on and the second relay is off, and the relay control unit determines that the first relay has failed when the input voltage is detected by the voltage detection unit in a state in which the first relay is off and the second relay is on.

Accordingly, a second aspect of the present invention provides a relay control apparatus included in an image forming apparatus comprising a heater configured to be supplied with electrical power from a power source, a first relay and a second relay configured to be each connected between the power source and the heater, and a voltage detection unit configured to detect presence or absence of an input voltage to the heater on paths from the first relay to the heater and from the second relay to the heater, comprising a first control unit configured to, before starting passage of electric current through the heater, output a control signal to turn on the first relay, and when the input voltage is not detected by the voltage detection unit, output a control signal to turn on the second relay, a first determination unit configured to determine that the second relay has failed in a case where the input voltage is detected by the voltage detection unit when the first relay is turned on by the first control unit, a second control unit configured to, before ending passage of electric current through the heater, output a control signal to turn off the first relay, and when the input voltage is not detected by the voltage detection unit, output a control signal to turn off the second relay, and a second determination unit configured to determine that the first relay has failed in a case where the input voltage is detected by the voltage detection unit when the first relay is turned off by the second control unit.

According to the present invention, in a circuit configuration in which the relays are connected to the respective both ends of the fixing heater, contact fusion occurring in the respective relays can be individually detected. Moreover, because contact fusion is detected for one of the relays when it is on, and for the other one of the relays when it is off, the time required to detect contact fusion of the two relays can be reduced.

Further features of the present invention will become apparent from the following description of exemplary embodiments (with reference to the attached drawings).

DESCRIPTION OF THE EMBODIMENTS

The present invention will now be described in detail with reference to the drawings showing an embodiment thereof.

Figure 1:
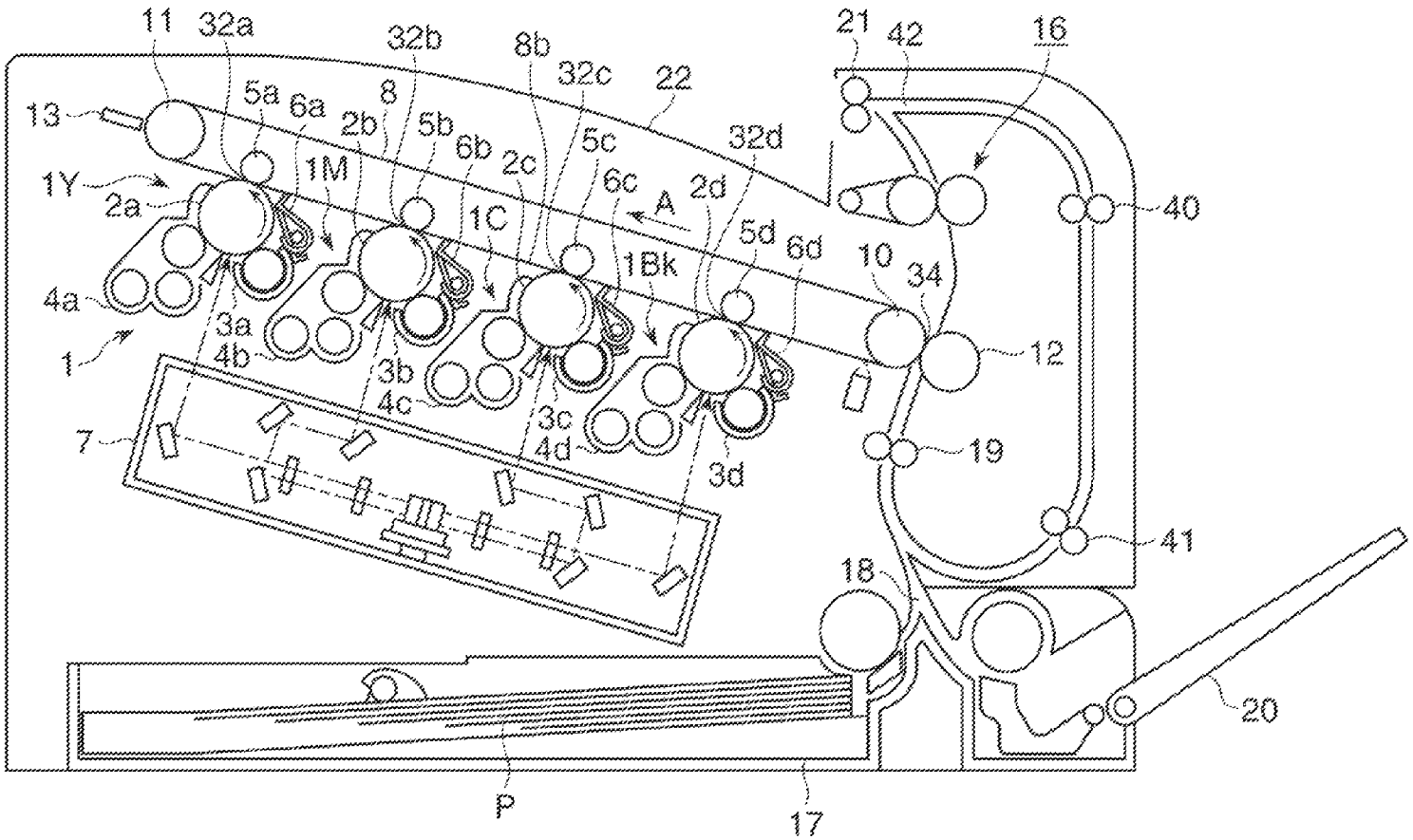
FIG. 1 is a cross-sectional view showing a general arrangement of a full-color printer which is an exemplary image forming apparatus according to an embodiment of the present invention.

FIG. 1 is a cross-sectional view showing a general arrangement of a full-color printer which is an exemplary image forming apparatus according to an embodiment of the present invention.

Referring to FIG. 1, the full-color printer (hereafter referred to merely as the "printer") has the following four image forming units: an image forming unit 1Y for forming yellow-color images, an image forming unit 1M for forming magenta-color images, an image forming unit 1C for forming cyan-color images, and an image forming unit 1Bk for forming black-color images. The image forming units 1Y, 1M, 1C, and 1Bk are arranged in a row at regular intervals.

In the image forming units 1Y, 1M, 1C, and 1Bk, drum-shaped electrophotographic photosensitive units (hereafter referred to as the "photosensitive drums") 2*a*, 2*b*, 2*c*, and 2*d* which are image carriers are disposed. Primary chargers 3*a*, 3*b*, 3*c*, and 3*d*, developing devices 4*a*, 4*b*, 4*c*, and 4*d*, and transfer rollers 5*a*, 5*b*, 5*c*, and 5*d*, which are transfer units, and drum cleaner units 6*a*, 6*b*, 6*c*, and 6*d* are disposed around the respective the photosensitive drums 2*a*, 2*b*, 2*c*, and 2*d*. An exposure unit 7 is placed at a lower portion between the primary chargers 3*a* to 3*d* and the developing devices 4*a* to 4*d*.

The developing devices 4*a* to 4*d* store yellow toner, cyan toner, magenta toner, and black toner, respectively.

The photosensitive drums 2*a* to 2*d* have photoconductive layers on drum bases which are negatively-charged OPC photosensitive units and made of aluminum, and rotatively driven by a drive unit (not shown) in directions indicated by arrows (clockwise as viewed in FIG. 1) at a predetermined process speed.

The primary chargers 3*a* to 3*d*, which are primary charging units, uniformly charge surfaces of the photosensitive drums 2*a* to 2*d* to a predetermined negative potential by charging biases applied from charging bias power sources (not shown).

The developing devices 4*a*, 4*b*, 4*c*, and 4*d* have toner therein, and attach toners of the respective colors to electrostatic latent images formed on the photosensitive drums 2*a* to 2*d* to develop (visualize) them as toner images.

The transfer rollers 5*a* to 5*d*, which are primary transfer units, are disposed so as to be brought into abutment with the respective photosensitive drums 2*a* to 2*d* in respective primary transfer areas 32*a* to 32*d* via an intermediate transfer belt 8.

The drum cleaner units 6*a*, 6*b*, 6*c*, and 6*d* each have a cleaning blade for removing transfer residual toner remaining on the photosensitive drums 2*a* to 2*d* after primary transfer from the photosensitive drums 2*a* to 2*d*, and others.

The intermediate transfer belt 8 is disposed on an upper surface side of the photosensitive drums 2*a* to 2*d*, and tightly stretched between a secondary transfer opposing roller 10 and a tension roller 11. The secondary transfer opposing roller 10 is disposed so as to be brought into abutment with a secondary transfer roller 12 in a secondary transfer area 34 via the intermediate transfer belt 8. The intermediate transfer belt 8 is made of a dielectric resin such as a polycarbonate, a polyethylene terephthalate resin film, or a polyvinylidene fluoride resin film.

Moreover, the intermediate transfer belt 8 has a primary transfer surface (lower flat surface) 8*b*, which is formed on a side opposing the photosensitive drums 2*a* to 2*d*, inclined with its secondary transfer roller 12 side down. Namely, the intermediate transfer belt 8 is movably opposed to upper surfaces of the photosensitive drums 2*a* to 2*d*, and has the primary transfer surface 8*b*, which is formed on the side opposing the photosensitive drums 2*a* to 2*d*, with its secondary transfer area 34 side down. Specifically, the inclination angle is set at about 15 degrees.

Moreover, the intermediate transfer belt 8 is tightly stretched by the secondary transfer opposing roller 10, which is disposed on the secondary transfer area 34 side and applies driving force to the intermediate transfer belt 8, and the tension roller 11 which is opposed to the secondary transfer opposing roller 10 across the primary transfer parts 32*a* to 32*d* and applies tension to the intermediate transfer belt 8.

The secondary transfer opposing roller 10 is disposed so as to be able to abut on the secondary transfer roller 12 in the secondary transfer area 34 via the intermediate transfer belt 8. A belt cleaning unit 13, which removes and collects transfer residual toner remaining on a surface of the intermediate transfer belt 8, is disposed outside the intermediate transfer belt 8 and in the vicinity of the tension roller 11. A fixing unit 16 is disposed in a vertical path configuration at a location downstream of the secondary transfer area 34 in a direction in which a transfer material (recording material) P is conveyed.

An exposure unit 7 is comprised of a laser emission unit, which emits light according to time-series electric digital pixel signals of given image information, a polygon lens, a reflex mirror, and so on. By exposing the photosensitive drums 2*a* to 2*d* to light, the exposure unit 7 forms electrostatic latent images of the respective colors according to image information on surfaces of the photosensitive drums 2*a* to 2*d* charged by the respective primary chargers 3*a* to 3*d*.

Next, a description will be given of a one-sided image forming operation performed by the printer in FIG. 1.

Upon an image formation start signal being issued, the photosensitive drums 2*a* to 2*d* of the respective image forming units 1Y to 1Bk, which are rotatively driven at a predetermined process speed, are uniformly charged to negative polarity by the respective primary chargers 3*a* to 3*d*. Then, the exposure unit 7 applies a color-separated image signal input from outside from a laser light emitting element, and thus forms electrostatic latent images of the respective colors on the respective photosensitive drums 2*a* to 2*d* via the polygon lens, the reflex mirror, and so on.

Then, the developing device 4*a* to which a developing bias of the same polarity as the charging polarity (negative polarity) of the photosensitive drum 2*a* is applied attaches yellow toner to the electrostatic latent image formed on the photosensitive drum 2*a*, and thus visualizes the electrostatic latent image as a toner image. In the primary transfer area 32*a* between the photosensitive drum 2*a* and the transfer roller 5*a*, the yellow toner image is primarily transferred onto the intermediate transfer belt 8 by the transfer roller 5*a* to which a primary transfer bias (opposite in polarity to the toner (positive polarity)) is applied.

The intermediate transfer belt 8 onto which the yellow toner image has been transferred is moved toward the image forming unit 1M. Then, in the image forming unit 1M as well, a magenta toner image formed on the photosensitive drum 2*b* in the same way as described above is superimposed on the yellow toner image on the intermediate transfer belt 8 in the primary transfer area 32*b*. On this occasion, transfer residual toner remaining on the photosensitive drums 2*a* to 2*d* is scraped off and collected by the cleaning blades or the like provided in the drum cleaning units 6*a* to 6*d*.

Thereafter, in the same way, cyan and black toner images formed on the photosensitive drums 2*c* and 2*d* of the image forming units 1C and 1Bk are sequentially superimposed on the yellow and magenta toner images transferred onto the intermediate transfer belt 8 in superimposed manner in the respective primary transfer areas 32*c* and 32*d*. Thus, full-color toner images are formed on the intermediate transfer belt 8.

Then, a leading end of the full-color toner images on the intermediate transfer belt 8 is moved to the secondary transfer area 34 between the secondary transfer opposing roller 10 and the secondary transfer roller 12. In accordance with this timing, a transfer material P selectively fed from a sheet feed cassette 17 or a manual feed tray 20 via a conveying path 18 is conveyed to the secondary transfer part 34 by registration rollers 19.

The full-color toner images are secondarily transferred onto the transfer material P, which has been conveyed to the secondary transfer part 34, in a collective manner by the secondary transfer roller 12 to which a secondary transfer bias (opposite in polarity to the toner (positive polarity)) is applied.

The transfer material P bearing the full-color toner images is conveyed to the fixing unit 16, which thermally fixes the full-color toner images on a surface of the transfer material P by heating and pressurizing the transfer material P. The transfer material P is then discharged onto a discharged sheet tray 22 by sheet discharging rollers 21, which completes the sequential image forming operation. It should be noted that secondary transfer residual toner or the like remaining on the intermediate transfer belt 8 is removed and collected by the belt cleaning unit 13.

Next, a description will be given of a double-sided image forming operation performed by the printer in FIG. 1.

The procedure for the double-sided image forming operation is the same as for the one-sided image forming operation before the point where the transfer material P is conveyed to the fixing unit 16, and the full-color toner images are heated and pressurized to be thermally fixed on the surface of the transfer material P. After that, the rotation of the sheet discharging rollers 21 is stopped in a state in which a major portion of the transfer material P has been discharged onto the discharged sheet tray 22 on an upper side of the main body by the sheet discharging rollers 21. On this occasion, a trailing end of the transfer material P has reached an invertible position 42.

Subsequently, the sheet discharging rollers 21 are reversely rotated so as to feed the transfer material P, the conveyance of which has been stopped by stopping the rotation of the sheet discharging rollers 21, into a double-sided path having double-sided rollers 40 and 41. By reversely rotating the sheet discharging rollers 21, the trailing end of the transfer material P which has been positioned at the invertible position 42, becomes a leading end and reaches the double-sided rollers 40. After that, the transfer material P is conveyed to the double-sided rollers 41 by the double-sided rollers 40, and sequentially conveyed toward the registration rollers 19 by the double-sided rollers 40 and 41. In the meantime, an image formation start signal is output, and the same operation as in the one-sided image forming operation described above is carried out. Specifically, the transfer material P is moved to the secondary transfer area 34 by the registration rollers 19 in accordance with the timing in which the leading end of the full-color toner images on the intermediate transfer belt 8 is moved to the secondary transfer area 34 between the secondary transfer opposing roller 10 and the secondary transfer roller 12.

In the secondary transfer area 34, the leading end of the toner images and the leading end of the transfer material P are matched together, and the toner images are transferred onto the transfer material P. After that, the toner images on the transfer material P are fixed by the fixing unit 16 as with the one-sided image forming operation. Then, the transfer material P is conveyed again by the sheet discharging rollers 21, and eventually discharged onto the discharged sheet tray 22, which completes the sequential image forming operation.

Figure 2:
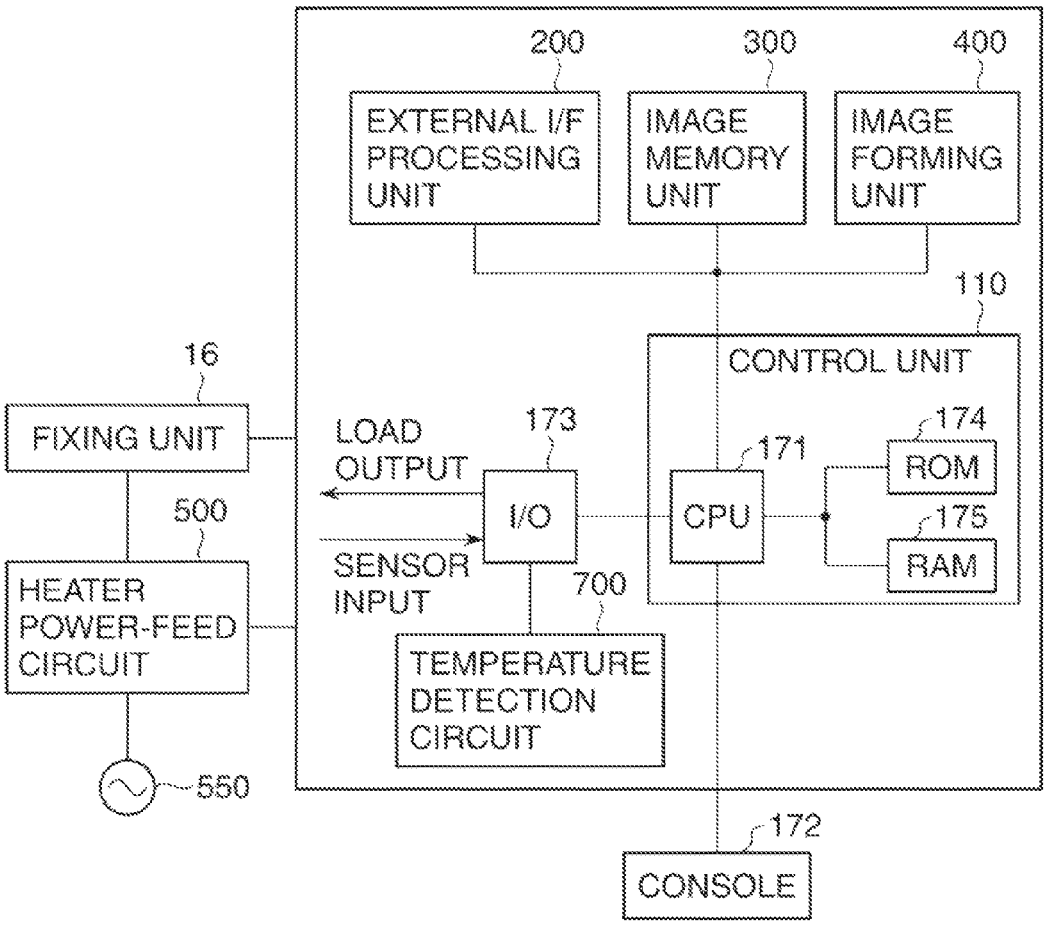
FIG. 2 is a block diagram showing a general arrangement of a control unit in the printer in FIG. 1.

FIG. 2 is a block diagram showing a general arrangement of a control unit in the printer in FIG. 1. It should be noted that in FIG. 2, only parts relating to the present invention and main functional units are illustrated, and other component elements and functional units are omitted.

Referring to FIG. 2, the control unit 110 is a basic control unit that controls the entire printer, and has a CPU 171, a ROM 174, and a RAM 175. The ROM 174 stores control programs and others. The RAM 175 is used as a work memory when the CPU 171 executes control programs. The CPU 171 is connected to the ROM 174 and the RAM 175 via an address bus and a data bus.

The CPU 171 is connected to sensors (not shown) for detecting various loads (not shown) such as motors and clutches and sheet positions, and a temperature detection circuit (also referred to herein as a "temperature detection unit") 700 via an I/O port 173. The fixing unit 16 and a heater power-feed circuit 500 that supplies electrical power of an AC power source 550 to a fixing heater (not shown) in the fixing unit 16 are connected to the I/O port 173, and the CPU 171 controls them. Specifically, by executing control programs read out from the ROM 174, the CPU 171 sequentially controls input and output via the I/O port 173, and controls the temperature of the fixing heater in the fixing unit 16.

A temperature detection signal output from a temperature sensor (not shown) in the fixing unit 16 is input to the temperature detection circuit 700 via the I/O port 173. The temperature detection circuit 700 outputs control signals to the heater power-feed circuit 500.

The CPU 171 is connected to a console 172 having a display unit (not shown), which produces screen displays, and a key input unit (not shown), and controls screens displayed on the console 172 and key inputs. By operating the key input unit, an operator instructs the CPU 171 to switch between image forming operation modes and screen displays. As a result, the CPU 171 displays operation mode settings according to printer conditions and key inputs.

The CPU 171 is also connected to an external I/F processing unit 200, an image memory unit 300, and an image forming unit 400. It should be noted that the image forming units 1Y, 1M, 1C, and 1Bk are included in the image forming unit 400.

The external I/f processing unit 200 sends and receives image data and processing data from external devices such as a PC. The image memory unit 300 carries out an image expansion process and a temporary image storage process. The image forming unit 400 has the image forming units 1Y, 1M, 1C, and 1Bk described above, and carries out a process in which it causes the exposure unit 7 to expose line image data, which has been transferred from the image memory unit 300, to light.

Figure 3:
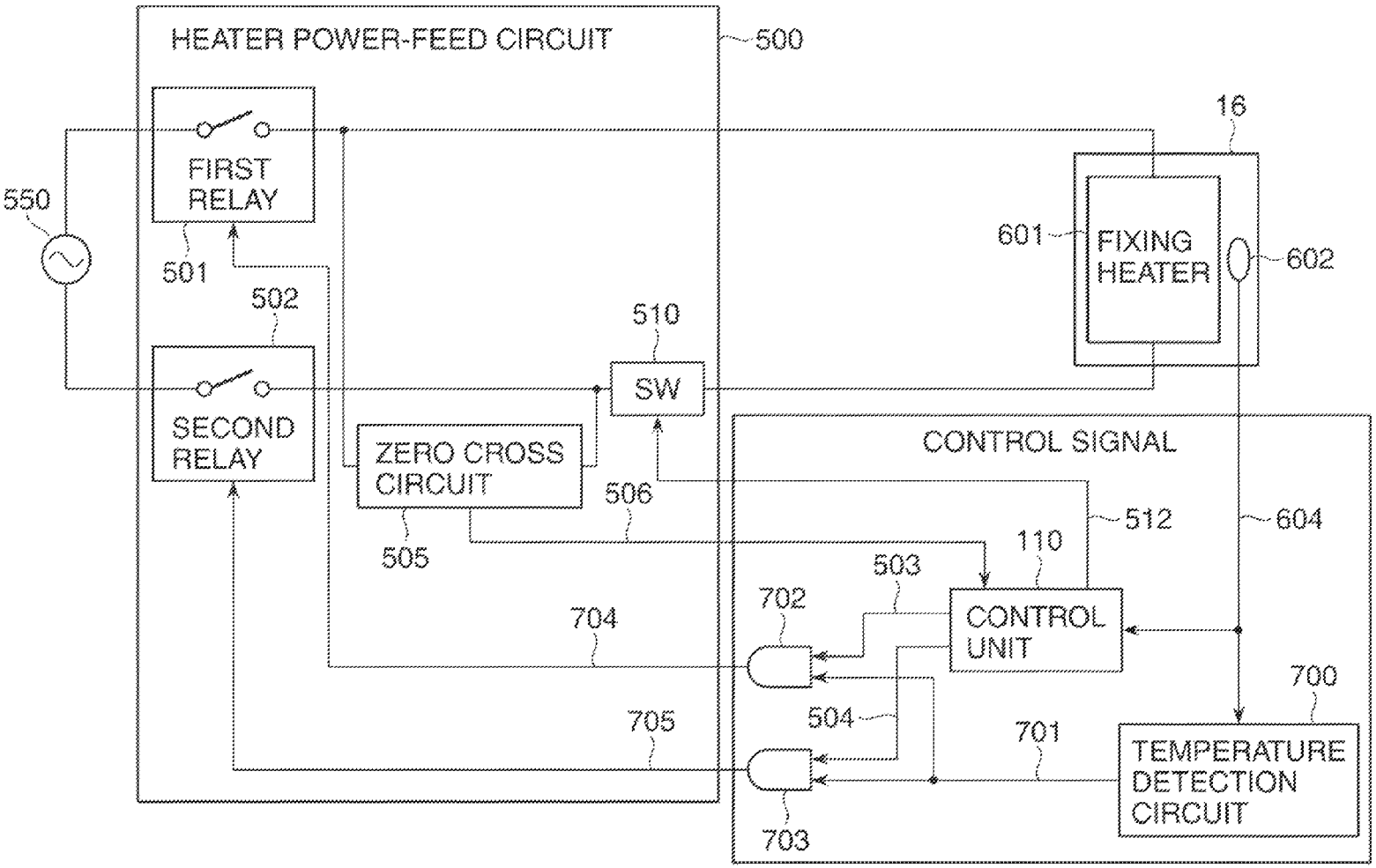
FIG. 3 is a diagram showing a general arrangement and a connecting relation of a heater power-feed circuit in FIG. 2.

FIG. 3 is a diagram showing a general arrangement and a connecting relation of the heater power-feed circuit 500 in FIG. 2.

The fixing unit 16 has a fixing heater 601, which is a heat source for heating and fixing toner images, and a temperature sensor 602 such as a thermistor, which is disposed in the vicinity of the fixing heater 601, for detecting the temperature of the fixing heater 601. It should be noted that the fixing unit 16 has a pressurizing roller and others, description of which is omitted.

The temperature sensor 602 is connected to the control unit 110 and the temperature detection circuit 700. A temperature detection signal 604 output from the temperature sensor 602 is input to the control unit 110 and the temperature detection circuit 700. The fixing heater 601 has both ends thereof connected to the heater power-feed circuit 500.

The heater power-feed circuit 500 has a first relay 501 and a second relay 502 for supplying/interrupting electrical power supplied from the AC power source 550 to both ends of the fixing heater 601. The first relay 501 has one end thereof connected to one end of the fixing heater 601, and the other end thereof connected to the AC power source 550. The second relay 502 has one end thereof connected to the other end of the fixing heater 601 via a semiconductor SW 510, and the other end thereof connected to the AC power source 550. The first relay 501 and the second relay 502 are controlled to be on and off by control signals 503 and 504 output from the control unit 110, which is a relay control unit. The control signals 503 and 504 output from the control unit 110 are input to a first AND circuit 702 and a second AND circuit 703, respectively, via the I/O port 173 in FIG. 2 described above.

A zero cross detection circuit 505 is connected in parallel to the fixing heater 601 and the AC power source 550 as illustrated in the figure. Upon being supplied with electrical power from the AC power source 550, the zero cross detection circuit 505 outputs a zero cross signal 506 (a detection signal) according to zero cross timing of an alternating waveform to the control unit 110 (a voltage detection unit). The zero cross signal 506 output from the zero cross detection circuit 505 is input to the control unit 110 via the I/O port 173 in FIG. 2 described above.

The semiconductor SW 510 is a semiconductor switch such as a triac (registered trademark), which is disposed on a path for supplying electrical power to the fixing heater 601, and capable of turning on and off power feeding to the fixing heater 601 irrespective of whether the first relay 501 and the second relay 502 are turned on or off. The semiconductor SW 510 is controlled to be on or off in response to a control signal 512 output from the control unit 110.

The control unit 110 outputs the control signal 512 in response to the temperature detection signal 604 from the temperature sensor 602. By controlling the semiconductor SW 510 to be on or off, the temperature of the fixing heater 601 is controlled.

The first AND circuit 702 is a logic circuit that performs logical conjunction (AND) based on the control signal 503 output from the control unit 110 and a control signal 701 output from the temperature detection circuit 700, and outputs a first AND signal 704 to the first relay 501. On the other hand, the second AND circuit 703 is a logic circuit that performs logical conjunction (AND) based on the control signal 504 output from the control unit 110 and the control signal 701 output from the temperature detection circuit 700, and outputs a second AND signal 705 to the second relay 502. Thus, when a control signal for turning off the first relay 501 and the second relay 502 is output from one or both of the control unit 110 and the temperature detection circuit 700, both relays are turned off.

The control unit 110 controls the temperature of the fixing heater 601 based on the temperature detection signal 604 from the temperature sensor 602. When determining that the temperature of the fixing heater 601 indicated by the temperature detection signal 604 is not less than a threshold value Tmax1, the control unit 110 determines that the fixing heater 601 has increased from a proper temperature, and stops power feeding to the fixing heater 601. Specifically, the control unit 110 outputs the control signal 512 for turning off the semiconductor SW 510 and outputs the control signals 503 and 504 for turning off the first relay 501 and the second relay 502.

On the other hand, the temperature detection circuit 700 functions as a heater temperature abnormality detection unit, and is able to stop power feeding to the fixing heater 601 based on the temperature detection signal 604 from the temperature sensor 602. Specifically, when determining that the temperature of the fixing heater 601 indicated by the temperature detection signal 604 is not less than a threshold value Tmax2, the temperature detection unit 700 determines that the fixing heater 601 is abnormally heating, and outputs the control signal 701 for stopping power feeding to the fixing heater 601.

Because the temperature detection circuit 700 outputs the control signal 701 for turning off the first AND circuit 702 and the second AND circuit 703, no signal for turning on the first relay 501 and the second relay 502 is output even if the control signals 503 and 504 for turning off the first relay 501 and the second relay 502 are input from the control unit 110. As a result, the first relay 501 and the second relay 502 are turned off, and power feeding to the fixing heater 601 is stopped.

The above described threshold values Tmax1 and Tmax2 have the following relationship, Tmax2>Tmax1. Thus, even when temperature cannot be controlled due to some abnormal condition such as runaway occurring in the CPU 171 in the control unit 110, power feeding to the fixing heater 601 can be stopped by the temperature detection circuit 700. As a result, the fixing heater 601 and its surrounding components can be protected, and abnormal fixing can be prevented.

Figure 4A:
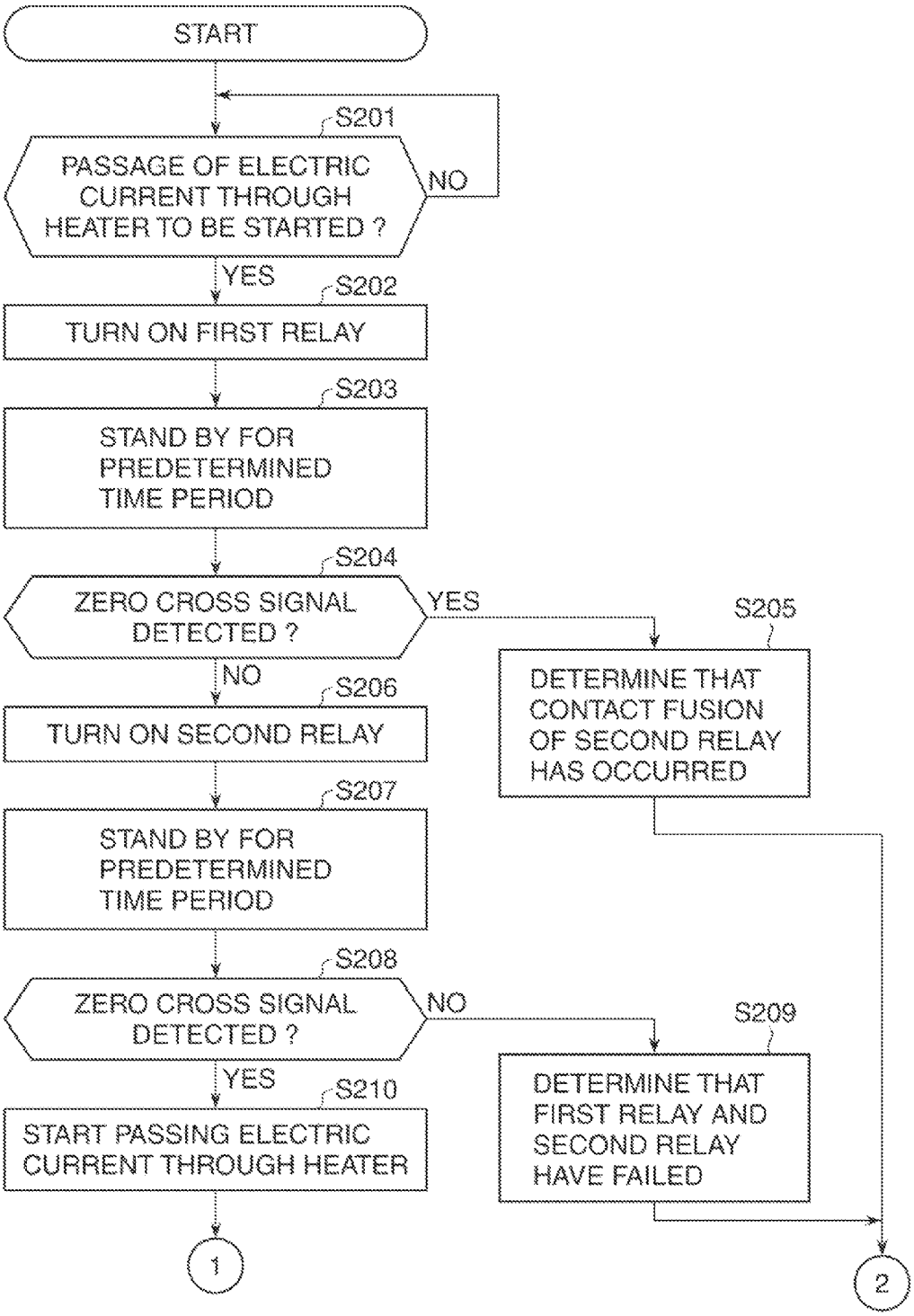
FIG. 4A is a flowchart I showing the flow of a process for detecting contact fusion of first and second relays.
Figure 4B:
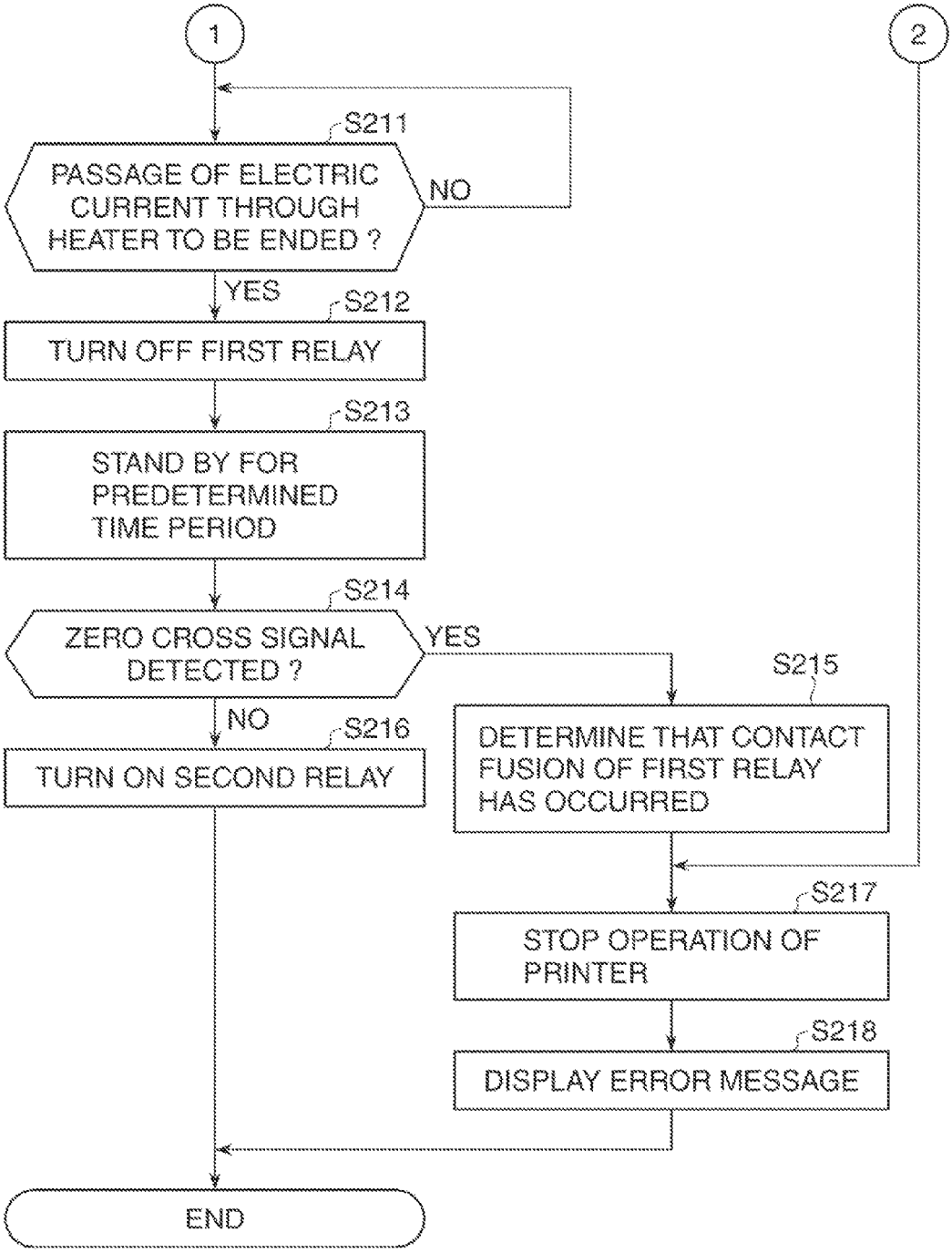
FIG. 4B is a flowchart II showing the flow of the process for detecting contact fusion of the first and second relays.

FIGS. 4A and 4B are flowcharts showing the flow of a process for detecting contact fusion of the first and second relays.

As shown FIG. 4A, the control unit 110 determines in step S201 whether or not to start passing electric current through the fixing heater 601. When determining to start the passage of electric current, the control unit 110 outputs the control signal 503 for turning on the first AND circuit 702, and turns on the first relay 501 in response to the first AND signal 704 output from the first AND circuit 702 (step S202). After that, the control unit 110 stands by for a predetermined time period (for example, 100 ms) (step S203). This aims at keeping contact connection stable because the first relay 501 is a mechanical relay.

Then, in step S204, the control unit 110 determines whether or not it has detected the zero cross signal 506 from the zero cross detection circuit 505. When the control unit 110 has detected the zero cross signal 506 (YES in the step S204), the control unit 110 proceeds to step S205.

In the step S205, the control unit 110 determines that electric current is being passed through the second relay 502 due to a failure such as contact fusion because the zero cross signal 506 is detected even though the control unit 110 has not output the control signal 504 for turning on the second relay 502. The step S205 is an exemplary first determination unit. Then, the control unit 110 stops the operation of the printer in FIG. 1 (step S217), and causes the display unit on the console 172 to display an error message (step S218), followed by terminating the process.

On the other hand, when in the step S204, the control unit 110 has not detected the zero cross signal 506, (NO in the step S204), the control unit 110 proceeds to step S206.

In the step S206, the control unit 110 outputs the control signal 504 for turning on the first AND circuit 703, and turns on the second relay 502 in response to the second AND signal 705 output from the second AND circuit 703. The step S206 is an exemplary first control unit. After turning on the second relay 502, the control unit 110 stands by for a predetermined time period (for example, 100 ms) (step S207). The reason for this is the same as in the step S203 described above.

Then, in the step S208, the control unit 110 determines whether or not it has detected the zero cross signal 506 from the zero cross detection circuit 505. When the control unit 110 has not detected the zero cross signal 506 (NO in the step S208), the control unit 110 proceeds to step S209.

In the step S209, the control unit 110 determines that electric current is not being passed through the first relay 501 and the second relay 502 due to a failure such as poor conduction because electric current is not being passed through the first relay 501 and the second relay 502 even though the first relay 501 and the second relay 502 are turned on. This failure can be detected irrespective of whether poor conduction occurs in one of the first relay 501 and the second relay 502 or both the first relay 501 and the second relay 502. The step S209 is an exemplary third determination unit. When determining that a failure such as poor conduction has occurred, the control unit 110 carries out the processes in the step S217 and the subsequent steps, followed by terminating the present process.

On the other hand, in the step S208, when detecting the zero cross signal 506, the control unit 110 determines that the first relay 501 and the second relay 502 properly work, and starts passing electric current through the fixing heater 601 (step S210), which enables an image forming operation to be carried out. In the step S210, the control unit 110 stars passing electric current through the fixing heater 601 by outputting the control signal 512 for turning on the semiconductor SW 510.

Referring to FIG. 4B, upon the image forming operation being completed, the control unit 110 determines whether or not to end the passage of electric current through the fixing heater 601 (step S211). When determining to end the passage of electric current, the control unit 110 outputs the control signal 503 for turning off the first AND circuit 702, and turns off the first relay 501 in response to the first AND signal 704 output from the first AND circuit 702 (step S212). After that, the control unit 110 stands by for a predetermined time period (for example, 100 ms) (step S213), and then determines whether or not it has detected the zero cross signal 506 (step S214). When detecting the zero cross signal 506 (YES in the step S214), the control unit 110 proceeds to step S215.

In the step S215, the control unit 110 determines that electric current is being passed through the first relay 501 due to a failure such as contact fusion because the zero cross signal 506 is detected even though the control unit 110 has not output the control signal 503 for turning on the first relay 501. The step S215 is an exemplary second determination unit. Then, the control unit 110 carries out the processes in the step S217 and the subsequent steps, followed by terminating the present process.

On the other hand, when in the step S214, the control unit 110 has not detected the zero cross signal 506, (NO in the step S214), the control unit 110 proceeds to step S216.

In the step S216, the control unit 110 outputs the control signal 504 for turning off the second AND circuit 703, and turns on the second relay 502 in response to the second AND signal 705 output from the second AND circuit 703. The step S216 is an exemplary second control unit. It should be noted that the above described process can be applied to a case where the locations of the first relay 501 and the second relay 502 are reversed.

After the passage of electric current is started in the step S210, the temperature detection circuit 700 stops power feeding to the fixing heater 601 based on the temperature detection signal 604 from the temperature sensor 602. Specifically, when determining that the temperature of the fixing heater 601 detected by the temperature sensor 602 is not less than the threshold value Tmax2, the control unit 110 determines that the fixing heater 601 is abnormally heating, and outputs the control signal 701 for stopping power feeding to the fixing heater 601.

After the passage of electric current is started in the step S210, the temperature detection circuit 700 also stops power feeding to the fixing heater 601 based on the temperature detection signal 604 from the temperature sensor 602. Specifically, when determining that the temperature of the fixing heater 601 detected by the temperature sensor 602 is not less than the threshold value Tmax1, the control unit 110 determines that the fixing heater 601 has increased from a proper temperature, and outputs the control signals 503 and 504 for stopping power feeding to the fixing heater 601.

According to the above described embodiment, before starting the passage of electric current through the fixing heater 601, the control unit 110 outputs a control signal to turn on the first relay 501, and when no input voltage has been detected by the zero cross detection circuit 505, outputs a control signal to turn on the second relay 502. In a case where an input voltage is detected by the zero cross detection circuit 505 when the first relay 501 is turned on, the control unit 110 determines that the second relay 502 has failed. Moreover, before ending the passage of electric current through the fixing heater 601, the control unit 110 outputs a control signal to turn off the first relay 501, and when no input voltage has been detected by the zero cross detection circuit 505, outputs a control signal to turn off the second relay 502. In a case where an input voltage is detected by the zero cross detection circuit 505 when the first relay 501 is turned off, the control unit 110 determines that the first relay 501 has failed. Thus, in the circuit configuration in which the relays are connected to the respective both ends of the fixing heater, contact fusion of the respective relays can be individually detected.

As described above, by staggering the operation timing of the two relays, contact fusion of each relay can be reliably detected. As a result, the time required for detecting contact fusion of the two relays can be reduced because the presence or absence of contact fusion is detected for one of the relays when it is on, and the presence or absence of contact fusion is detected for the other one of the relays when it is off.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-106404 filed May 6, 2010, which is hereby incorporated by reference herein in its entirety.

What is claimed is:

1. An image forming apparatus comprising:

an image forming section configured to form a toner image on a sheet;

a heater configured to be supplied with AC electrical power from an AC power source so as to thermally fix the image formed by said image forming section on the sheet;

a first relay configured to be connected between the AC power source and one end of said heater;

a second relay configured to be connected between the AC power source and another end of said heater;

a voltage detection circuit, which is provided in a stage subsequent to said first and second relays and is connected in parallel to said heater, configured to detect the presence or absence of inputting AC voltage into said heater; and a relay control unit configured to output relay control signals for turning on and off respective ones of said first relay and said second relay and configured to output heater control signals for switching on or off said heater, wherein said relay control unit outputs the relay control signals for turning on said first relay and turning off said second relay before switching on said heater according to the heater control signals, and then outputs the relay control signals for turning on said second relay if said voltage detection circuit does not detect inputting the AC voltage and determines that said second relay has failed if said voltage detection circuit detects inputting the AC voltage and said relay control unit outputs the relay control signals for turning off said first relay and turning on said second relay before switching off said heater, and then outputs the relay control signals for turning off said second relay if said voltage detection circuit does not detect inputting the AC voltage and determines that said first relay has failed if said voltage detection circuit detects inputting the AC voltage.

2. An image forming apparatus according to claim 1, further comprising:

a switch unit which is disposed between said heater and said second relay, configured to switch providing or not providing the AC voltage into said heater; and a temperature detection unit configured to detect a temperature of said heater and output a temperature detection signal to said relay control unit, wherein said relay control unit controls the temperature of said heater by controlling said switch unit based on the temperature detection signal.

3. An image forming apparatus according to claim 2, further comprising a heater temperature abnormality detection unit configured to determine whether the temperature of said heater is higher than a predetermined temperature based on the temperature detection signal output from said temperature detection unit, wherein said heater temperature abnormality detection unit outputs a relay control signal to turn off said first relay and said second relay when determining that the temperature of said heater is higher than the predetermined temperature.

4. An image forming apparatus according to claim 3, further comprising a computation unit configured to perform an AND operation of the control signal from said heater temperature abnormality detection unit and the control signals from said relay control unit, wherein said computation unit outputs signals to turn off said first relay and said second relay based on the control signal for turning off said first relay and said second relay, which is input from one of said heater temperature abnormality detection unit and said relay control unit.

5. An image forming apparatus according to claim 1, wherein said voltage detection circuit detects the zero cross of the AC voltage supplied from said AC power source.

* * * * *